United States Patent [19]

Graessley

[11] 4,283,762

[45] Aug. 11, 1981

[54] ANALOG COMPUTER CIRCUIT FOR CONTROLLING A FUEL INJECTION SYSTEM DURING ENGINE CRANKING

[75] Inventor: William J. Graessley, Ypsilanti, Mich.

[73] Assignee: Ford Motor Company, Dearborn, Mich.

[21] Appl. No.: 83,018

[22] Filed: Oct. 9, 1979

[51] Int. Cl.[3] ..... F02B 3/10; F02M 51/00

[52] U.S. Cl. ..... 364/431; 123/435; 123/491; 364/569

[58] Field of Search ..... 369/431, 569; 123/179 L, 435, 437, 438, 491, 492, 493

[56] References Cited

U.S. PATENT DOCUMENTS

| | | | |
|---|---|---|---|
| 4,143,621 | 3/1979 | Long | 123/491 |
| 4,148,282 | 4/1979 | Grassle et al. | 123/491 X |
| 4,176,625 | 12/1979 | Stauffer | 364/431 X |
| 4,180,025 | 12/1979 | Steinbrenner et al. | 123/493 |
| 4,184,460 | 1/1980 | Harada et al. | 364/431 X |
| 4,205,635 | 6/1980 | Kirn et al. | 123/179 L X |
| 4,208,991 | 6/1980 | Reddy | 123/179 L X |
| 4,221,194 | 9/1980 | Wright | 123/491 X |

*Primary Examiner*—Felix D. Gruber

*Attorney, Agent, or Firm*—Peter Abolins; Clifford L. Sadler

[57] ABSTRACT

An analog computer circuit for controlling a fuel injection system during engine cranking. The fuel injection system has an electrically controllable fuel injector that is intermittently actuated. The analog computer circuit develops a logic level signal having cyclically recurring time intervals that vary depending upon the manner in which a capacitor is charged from a DC voltage supply. Several electrical impedances are selectively placed in circuit with the capacitor and the voltage supply to control its rate of charging during engine cranking.

8 Claims, 2 Drawing Figures

ANALOG COMPUTER CIRCUIT FOR CONTROLLING A FUEL INJECTION SYSTEM DURING ENGINE CRANKING

CROSS REFERENCE TO RELATED APPLICATIONS

This invention is related to my concurrently-filed and commonly-assigned applications Ser. No. 83,016 entitled "A Method for Extending the Range of Operation of an Electromagnetic Fuel Injector" and Ser. No. 83,017 entitled "A Fuel Injector Control System for a Fuel Injected Internal Combustion Engine".

BACKGROUND

This invention relates to an analog computer circuit for controlling a fuel injection system during engine cranking. During the cranking of a fuel-injected engine, it is important to provide fuel to the engine at a rate that is primarily related to the temperature of the engine. The fuel required for starting an engine at cold engine temperatures is considerably greater than that required at warmer engine temperatures. Various schemes have been proposed to provide fuel enrichment during engine cranking or starting to help assure a quick engine start. Unfortunately, the fuel required by an engine during cranking is not a linear function of engine temperature and it should be provided, in a fuel injected engine, at a rate that is related to the engine cranking speed.

PRIOR ART

U.S. Pat. No. 3,555,305 to Luczkowski describes a pulse-generating circuit that produces pulses of adjustable durations.

U.S. Pat. No. 3,711,729 to Quiogue discloses a monostable multivibrator that produces output pulses of different widths depending on the time duration of an input pulse. The resistive components of an RC network also determine the output pulse width and include a pair of normally conducting transistor switches and RC pathes having a capacitor in common.

U.S. Pat. No. 4,015,141 to Reiter describes a variable threshhold comparator.

Also of general interest are U.S. Pat. No. 3,873,855 to Reddy; U.S. Pat. No. 4,023,046 to Renirie; and U.S. Pat. No. 3,987,392 to Kugelmann et al.

SUMMARY OF THE INVENTION

The present invention provides an analog computer circuit for controlling a fuel injection system for an internal combustion engine during engine cranking. The fuel injection system is of the type that includes at least one electrically controllable fuel injector. The fuel injector, when energized, delivers a quantity of fuel to the engine that is proportional to the duration of the energization of the fuel injector. The fuel injection system of the invention further includes, as is typical, circuit means coupled to the fuel injector for controlling the energization of the fuel injector in response to, and for the duration of, a cyclical logic level signal. The logic level signal is generated by the analog computer circuit of the invention and is suitable for use, in conjunction with the typical fuel injection circuit means mentioned above, for controlling the electrically controllable fuel injector.

The analog computer circuit includes a suitable DC voltage supply and a plurality of electrical impedances coupled to it. Also included is a capacitor and a plurality of switching devices that are used to couple the electrical impedances to the capacitor. Circuitry is provided for controlling the switching devices as a function of the ratio of the voltage across the capacitor to the voltage of the DC supply. Additionally, circuitry is provided for charging the capacitor from the DC voltage supply through the plurality of electrical impedances. The electrical impedances are selectively switched into conductive circuit with the capacitor by the switching devices. Also provided is a circuit for causing the discharge of the capacitor at a frequency proportional to the engine speed during engine cranking. The aforementioned cyclical logic level signal is generated by a circuit that produces a logic voltage level that recurs cyclically and has a duration that is proportional to the time over which the capacitor is charged through the selected impedance or impedances prior to its discharge.

The invention may be better understood by reference to the detailed description which follows and to the drawings.

DETAILED DESCRIPTION

Figure 1:
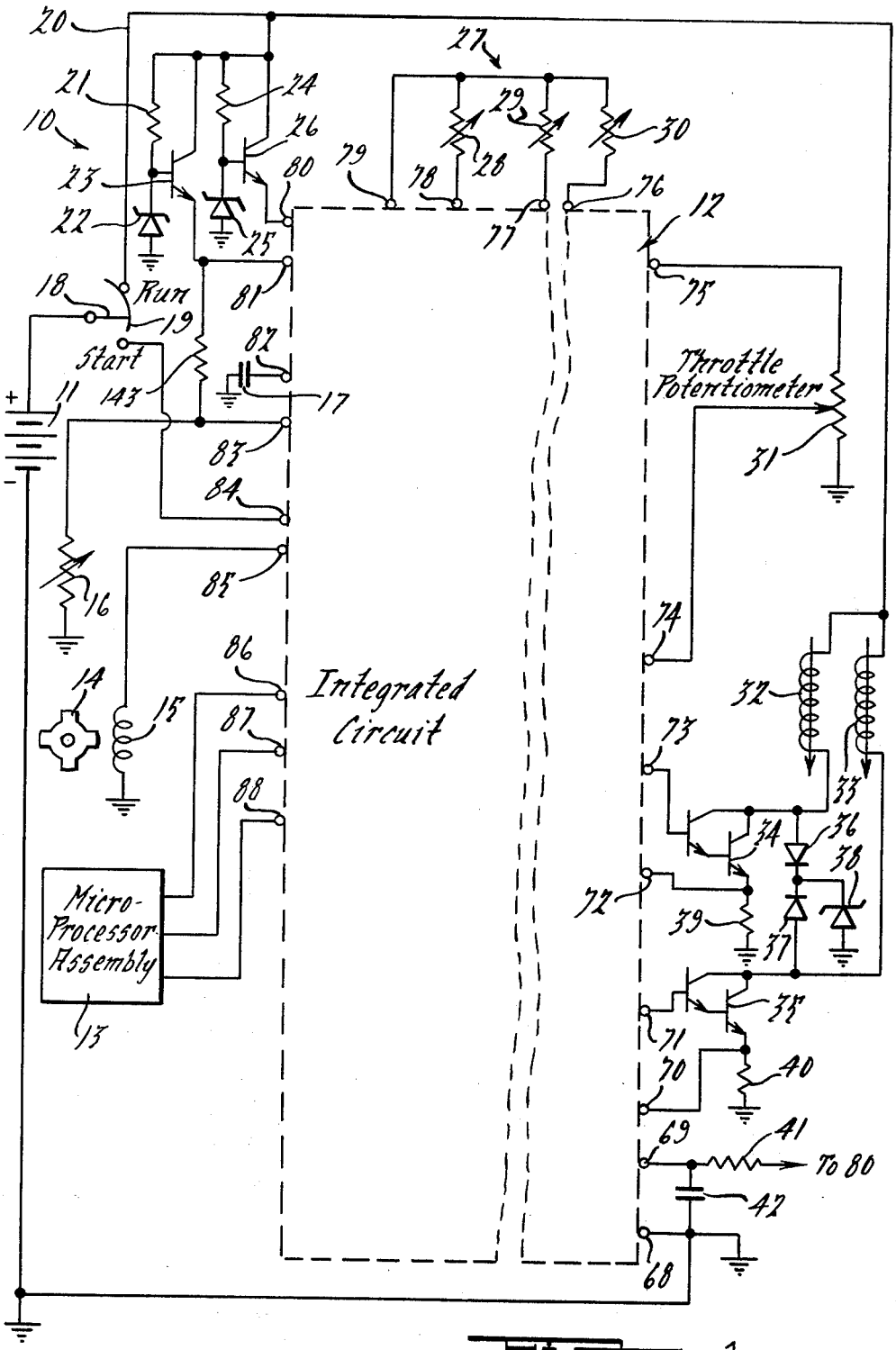
FIG. 1 is a schematic electrical diagram of a fuel injection system for a motor vehicle having an internal combustion engine.

With reference now to the drawings, wherein like numerals refer to like elements in the two figures, there is shown in FIG. 1 a fuel injection system, generally designated by the numeral 10, for an internal combustion engine (not shown). The system includes a DC storage battery 11, which may be a conventional nominally twelve-volt battery that receives a higher voltage input from the usual engine charging system during operation of the engine. The battery 11 is used to supply the DC potential required for operation of the circuitry of FIG. 1 which includes an integrated circuit 12.

Preferably, the fuel injection system includes a microprocessor assembly 13, a crankshaft driven pulse generating mechanism comprising a four-toothed reluctance wheel 14 and associated inductive sensing element 15. The inductive sensing device 14, 15 provides reference pulses PR that are supplied to the integrated circuit 12. The PR pulses occur at the rate of four pulses per revolution of the crankshaft of the internal combustion engine by which the toothed wheel 14 is driven. A pulse-shaping amplifier (not shown) may be used to improve the characteristics of the pulses PR supplied to the terminal 85 of the integrated circuit 12.

The integrated circuit 12 has twenty-one terminal pins shown and identified by the numerals 68 through 88. A variable resistor 16 is a negative temperature coefficient device responsive to engine coolant temperature. It is connected through a resistor 143 to a voltage supply connected to terminal 81, and the junction of resistors 16 and 143 is connected to terminal 83 of the integrated circuit. Other sensor devices providing a signal representative of engine operating temperature may be substituted for resistors 16 and 143. A capacitor 17 is connected between terminal 82 of the integrated circuit and ground and performs a timing function in association with other components both within and external of the integrated circuit. The timing function is useful in controlling fuel injection during cranking of the engine and when the microprocessor assembly 13 is in a default mode of operation.

The positive terminal of the DC storage battery 11 is connected to an ignition switch 18, while the negative terminal of the storage battery is connected by the usual grounding strap to the engine block. The ground terminal 68 of the integrated circuit also is connected to the engine block and, thus, is grounded as well. During engine cranking, there is, however, a large starter motor current that results in a significant potential difference between the ground at terminal 68 of the integrated circuit and the ground on the negative terminal of the DC storage battery. This is due to flow of the starter motor current through the ground strap typically interconnecting the negative terminal of the DC storage battery 11 and the engine block. This voltage drop decreases the voltage available for application to the inductive elements of electromagnetic fuel injectors 32 and 33 having the usual inductive elements which are connected, respectively, through Darlington transistors 34 and 35 and low-value sensing resistors 39 and 40 to the ground on the engine block.

The ignition switch 18 has a movable element 19 that contacts a terminal labeled "run" during normal engine operation and, during start or cranking of the engine, contacts both this terminal and the "start" terminal connected to terminal 84 of the integrated circuit. The "run" terminal is connected by line 20 to the inductive elements of the fuel injectors 32 and 33. Thus, it is seen that very nearly the full potential difference across the DC storage battery 11 is applied across the injector inductive elements when the Darlington transistors 34 and 35 are fully conductive. The resistors 39 and 40 connected in series with each of the Darlington transistors 34 and 35 and the associated inductive elements of the fuel injectors are of very small resistance value, for example, 0.33 ohm, and the voltage drop across these current-sensing resistors is quite small.

Zener diode 38 has its anode connected to ground and has its cathode connected to the junction formed between the cathodes of conventional diodes 36 and 37. Diode 36 has its anode connected to the collector of the Darlington transistor 34 and is forward biased when the voltage between the collector of transistor 34 and ground exceeds the combined voltage across the forward-biased diode 36 and the reverse-biased zener diode 38, which of course breaks down. The combined voltage drop across diodes 36 and 38 or 37 and 38 is about 24 volts when the zener 38 is conducting. The diodes provide current paths for dissipation of the magnetic field energy present when the Darlington transistors are rendered nonconductive. The diodes also provide protection for the Darlington transistors against the effects of transient voltages. The fuel injectors 32 and 33 typically are energized intermittently and alternately under control of the microprocessor assembly 13 so that conduction alternates through diodes 36 and 38 and diodes 37 and 38 upon de-energization of the respective injectors. The transistors 34 and 35 control the conduction of current through the injectors 32 and 33 through base drive signals applied, respectively, to terminals 73 and 71 of the integrated circuit 12. A positive logic-level voltage applied to the terminal 73 provides the base drive for the transistor 34 and causes the inductive element of the fuel injector 32 to be energized. Similarly, a positive logic-level voltage applied to the terminal 71 of the integrated circuit causes the transistor 35 to conduct in its collector-emitter output circuit and energizes the inductive element of the fuel injector 33. Simultaneous energization of the fuel injectors is possible by the concurrent existence of positive voltages on the integrated circuit terminals 73 and 71.

The circuit of FIG. 1 includes a resistor 21 having one of its terminals connected to line 20 and having its other terminal connected to the cathode of a zener diode 22 whose anode is grounded. The resistor 21, the zener diode 22 and the emitter follower transistor 23 together comprise a voltage regulator that is used to supply a regulated DC voltage to terminal 81 of the integrated circuit. This regulated voltage, designated VREF in FIG. 2, also appears at terminal 75 of the integrated circuit. A throttle potentiometer 31 has its resistive element connected between the terminal 75 and ground potential. The movable arm of the potentiometer provides a voltage signal at integrated circuit terminal 74 that is of a magnitude directly proportional to the angular position of the throttle typically used to control the amount of air that enters the internal combustion engine with which the fuel injection system is associated.

A second voltage regulator comprising resistor 24, zener diode 25 and emitter-follower transistor 26 is provided to supply a regulated DC voltage at integrated circuit terminal 80. This voltage, identified as VLOS in FIG. 2, is used as the supply voltage for the integrated circuit components including the various logic gates and amplifiers therein.

A calibration assembly, generally designated by the numeral 27, includes resistor elements 28, 29 and 30, which may be varied for calibration of the fuel injection system with respect to injector energization time per PR pulse in the engine cranking and microprocessor-default modes of engine operation. The capacitor 17 is charged through resistor 28 when the temperature-sensing resistor 16 indicates "hot" engine operation. Resistors 28 and 29 are used in charging the capacitor 17, one resistor at a time, when the engine is "warm". All three of the calibration assembly resistors 28, 29 and 30 are separately used in charging the capacitor 17 when the engine is "cold" as sensed by the thermistor 16. The "hot" temperature may be equal to or greater than normal engine operating temperature. During engine cranking, which may occur after the engine has been operated for a substantial time period, the engine temperature could be higher than normal engine operating temperature.

Figure 2:
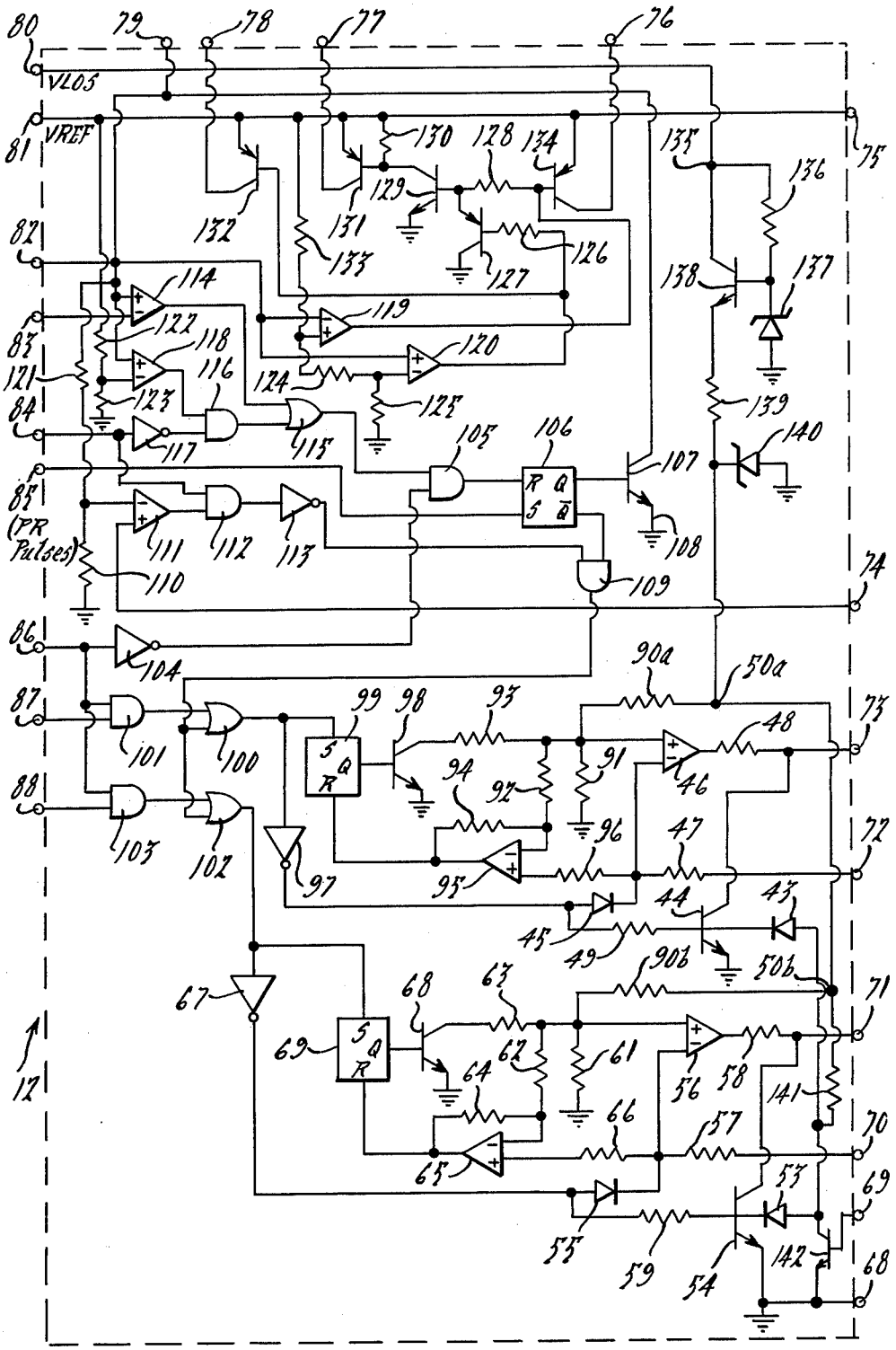
FIG. 2 is a schematic electrical diagram of an integrated circuit utilized in the system schematically illustrated in full in FIG. 1.

With particular reference now to FIG. 2, there is shown a detailed schematic electrical diagram of the circuitry included within the integrated circuit 12. The circuit of FIG. 2 includes a first portion that is used in the control of the duration of the voltage pulses applied to the bases of the Darlington transistors 34 and 35 via terminals 73 and 71, respectively. This first portion of the FIG. 2 circuitry is located in the upper half thereof and is operational during engine cranking (starting). In the lower half of FIG. 2, there is shown circuitry which is used both during engine cranking and during engine control with the aid of the microprocessor assembly 13 of FIG. 1. This circuitry in the lower portion of FIG. 2 is responsive only to pulses applied at terminals 87 and 88 during normal engine operation. Pulses having a duration corresponding to the duration of the pulses applied to terminals 87 and 88 appear at output terminals 73 and 71, respectively, to cause conduction of the Darlington transistors 34 and 35 and energization of the respective electromagnetic fuel injectors 32 and 33. During engine cranking and default of the microprocessor assembly 13, the circuitry in the upper portion of FIG. 2 determines the duration of the pulses at terminals 73 and 71. In these modes of engine operation, control of the circuitry in the lower portion of FIG. 2 by the microprocessor assembly 13 is inhibited by the application of a logic zero level signal at terminal 86 in FIG. 2. This logic zero signal is inverted by the inverter 104 to allow pulses from the upper portion of the circuitry to be transmitted through the AND-gate 105 to a type RS flip-flop 106. The flip-flop 106 has an output Q which has a duration at one logic level voltage that determines the duration of the pulses that appear at terminals 73 and 71 during the engine cranking and microprocessor-default modes. The manner in which this results is described in the following paragraphs.

With particular reference to the circuitry in the upper portion of FIG. 2, it may be noted that the capacitor 17 is connected between ground and terminal 82, as shown in FIG. 1. In FIG. 1 it also may be seen that the negative temperature coefficient resistor or thermistor 16 has one of its terminals connected to ground and has its other terminal connected through a resistor 143 to the reference voltage supply VREF. The junction between the temperature sensitive resistor 16 and the resistor 143 is connected to terminal 83 of the integrated circuit. During engine cranking and other times there is a voltage at terminal 83 that is proportional to the engine operating temperature. This voltage is applied in the integrated circuit to the negative input of a threshhold detector or comparator 114. The positive input of the threshhold detector 114 is connected to the terminal 82 leading to the capacitor 17.

The voltage at terminal 83 is inversely related to the engine operating temperature. The capacitor 17 is supplied repeatedly with a charging current that allows its voltage to increase as a function of one or more resistance-capacitance (RC) time constants. When the voltage on the capacitor 17, which voltage is applied via terminal 82 to the positive input of the threshold detector 114, becomes equal to the voltage at the terminal 83, which voltage is proportional to engine operating temperature, the threshhold detector 114 at its output produces a logic one level voltage that is transmitted through OR-gate 115 and AND-gate 105 to the reset terminal R of the flip-flop 106. This produces a logic one level at the Q-output of the flip-flop 106 that supplies the base drive for a transistor 107, which is connected in parallel with the capacitor 17 and rapidly discharges this timing capacitor. Prior to the discharge of the capacitor, the Q-output of the flip-flop 106 is at a logic zero level and its $\bar{Q}$-output is at a logic one level. The logic one level is transmitted through the AND-gate 109 to the OR-gates 100 and 102. The resulting logic one level signals at the outputs of the OR-gates 100 and 102 are translated, in a manner hereinafter described, to the logic-level voltage pulses at terminals 73 and 71 that drive, for their duration, the Darlington transistors 34 and 35 during engine cranking and microprocessor assembly default. Thus, as long as the $\bar{Q}$-output of the flip-flop 106 remains at a logic one level, pulses appear at terminals 73 and 71 to drive the Darlington transistors.

The flip-flop 106 is set such that its Q-output is at a logic zero level and its $\bar{Q}$-output at a logic one level each time a pulse appears at terminal 85. The PR pulses that are applied to this terminal are obtained from the engine crankshaft position sensor comprising components 14 and 15, as was previously described in connection with FIG. 1. In the application of the system to an eight-cylinder, four-cycle internal combustion engine, there would be one PR pulse for each cylinder firing. Typically, there is one PR pulse occurrence each time one of the pistons in the eight-cylinder engine reaches it top-dead-center position. When a PR pulse occurs, the $\bar{Q}$-output becomes a logic one level output that causes the onset of a voltage pulse at each of the terminals 73 and 71. The capacitor 17 then begins to charge. This capacitor charging and the logic-level pulses at terminals 73 and 71 continue until the threshhold detector 114 causes the reset pulse to appear at the R-input of the flip-flop 106. At the end of the charging, upon occurrence of the reset pulse, fuel injectors 32 and 33 are de-energized.

The circuitry in the upper portion of FIG. 2 is used to control fuel injection during both the engine cranking and microprocessor-default modes of engine operation. This control results from the use of threshhold detector 114 to determine the length of time occurring between the setting of the flip-flop 106 and the resetting thereof in the engine cranking mode. In the microprocessor-default mode, this time span is controlled by threshhold detector 118 which has a reference voltage established at its negative input by resistors 122 and 123. When the capacitor 17 voltage at the positive input of the threshhold detector exceeds the reference voltage, the output of the detector becomes a logic one level that is passed through an AND-gate 116 and gates 115 and 105 to reset the flip-flop 106 following its being set by a PR pulse. The charging rate of the capacitor 17 is affected only by engine operating temperature and capacitor voltage as hereinafter described.

During engine cranking, the ignition switch is in a position such that a positive voltage is applied to both of its poles labeled "run" and "start". The "start" pole is connected to terminal 84 and is thus at a logic one level during engine cranking. Inverter 117 uses this signal to cause AND-gate 116 to block the signals from threshhold detector 118. Also, the terminal 84 logic one level is applied to an AND-gate 112 that receives another input from a threshhold detector 111. Threshhold detector 111 has its positive input connected to the throttle potentiometer via terminal 74 and has its negative input supplied with a reference voltage, through resistors 110 and 121, that represents a selected open-throttle or fully open throttle position. When the throttle is open at least to the selected position, the AND-gate 112 has a logic zero condition at its output.

Whenever the output of AND-gate 112 is a logic zero level, as it is both during engine cranking and microprocessor default, inverter 113 converts a logic zero level to a logic one level to be applied to one input of AND-gate 109. This gate then is enabled to pass pulses from the flip-flop 106. During engine cranking, this can occur only if the throttle is open; this provides a dechoking function.

In summary, during engine cranking, the threshhold detector 114 controls the duration of pulses that pass through the OR-gate 115 and the AND-gate 105 to reset the flip-flop 106 and terminate the injection-duration control pulses at terminals 73 and 71. The control pulses being generated upon each occurrence of a PR pulse. The threshhold detector 118 controls the pulses that pass through the OR-gate 115 to RESET the flip-flop 106 during microprocessor default. The threshhold detectors 114 and 118 sense the voltage across the capacitor 17, which is charged at a rate related to the engine temperature during both engine cranking and microprocessor default. The negative input of the threshhold detector 118 is connected to the junction between resistors 122 and 123, which together form a voltage divider between the reference voltage VREF and ground potential. When the voltage on the capacitor, as sensed at terminal 82, exceeds the reference voltage at the negative input of the threshhold detector 118, the output voltage of the threshhold detector becomes a logic one level that is applied to the reset input of the flip-flop 106 in the manner previously mentioned. Each time a PR pulse occurs during such default operation, the flip-flop 106 is once again SET to initiate the onset of voltage pulses at terminals 73 and 71. This renders the Darlington transistors 34 and 35 conductive and energizes the fuel injectors 32 and 33.

The occurrence of each PR pulse at terminal 85 initiates simultaneous energization of the intermittently actuated electromagnetic fuel injectors 32 and 33. The duration of the fuel injection pulses is controlled by the charging of the capacitor 17. This charging occurs only while the flip-flop 106 is in its SET condition, said condition being initiated by the occurrence of the PR pulses at the set input S of the flip-flop 106. Under such circumstances, the Q-output of the flip-flop 106 becomes a logic zero level inhibiting conduction in the collector-emitter circuit of the transistor 107. Whenever the transistor 107 is nonconductive, the capacitor 17 is permitted to charge through circuitry connected to terminal 79 in a manner hereinafter described. When the flip-flop 106 is RESET by the application of a pulse to the RESET input R of flip-flop 106, the transistor 107 becomes conductive and shunts the capacitor charge to ground at 108. The flip-flop 106 is maintained in the RESET condition until the occurrence of the next PR pulse. As long as the flip-flop 106 is in the RESET condition, the transistor 107 conducts and prevents the accumulation of charge in the capacitor 17.

In the FIG. 2 circuitry, the transistors 134, 131 and 132 each are of the PNP type and have their emitters connected to the reference supply voltage VREF. The collectors of each of these transistors are connected, respectively, through calibration resistors 30, 29 and 28 in the calibration assembly 27. The commonly connected terminals of the resistors 30, 29 and 28 are connected to the junction 79, which in turn is connected through the integrated circuit 12 to the terminal 82 leading to the capacitor 17. Capacitor 17 charges through selective conduction of the transistors 134, 131 and 132 and resulting current flow through their respectively associated resistors 30, 29 and 28. Which and how many of the transistors 134, 131 and 132 is conductive during a capacitor 17 charging interval depends upon the engine operating temperature.

If the engine is hot (at or above normal engine operating temperature), then only the transistor 132 and the resistor 28 are used in charging the capacitor 17 from the VREF voltage supply. This is because the voltage at the negative input of the threshhold detector 114, obtained via terminal 83 connected to the temperature sensing thermistor 16, is at a low voltage level indicating the hot engine temperature. Upon each occurrence of a PR pulse, the capacitor 17 starts to charge through the transistor 132, which is maintained conductive in its emitter-collector output circuit as a result of the base of the transistor 132 being connected to ground potential through the output circuit of a threshhold detector 120. The negative input of the threshhold detector 120 is set at a reference voltage level established at the junction of resistors 124 and 125, which together with a resistor 133 are connected in a voltage divider between the voltage source VREF and ground potential. Preferably, the voltage established at the junction between resistors 124 and 125 is about 0.44 of the potential of VREF relative to ground. The voltage on the terminal 82 connected to the capacitor 17 is sensed at the positive input of the threshhold detector 120. When the capacitor voltage exceeds the reference voltage at the negative input of the threshhold detector, the output of the threshhold detector 120 becomes a logic one level that inhibits conduction of the transistor 132 due to the application of the higher potential to the base of this transistor. However, when the engine is hot, as stated above, the threshhold detector 114 (or the threshhold detector 118) resets the flip-flop 106 prior to the appearance of a logic one level at the output of the threshhold detector 120. If, on the other hand, the engine is in a warm condition, the logic one level does appear at the output of the threshhold detector 120 before the capacitor voltage applied to the positive input of the threshhold detector related to engine operation temperature.

If the engine temperature is such that the voltage at terminal 83 is below the reference voltage established at the negative input of the threshhold detector 120, then the flip-flop 106 is not reset prior to the occurrence of a logic one level at the output of the threshhold detector 120. This occurs if the engine is warm or cold, rather than hot. In such case, the logic one level at the output of the threshhold detector 120 is applied to the base of the transistor 132 rendering it nonconductive. This logic one level also is applied through a resistor 126 to the base of a transistor 127 to render it nonconductive. When the transistor 127 is rendered nonconductive, the transistor 129 no longer has its base-emitter junction shunted through the emitter-collector output circuit of the transistor 127. This allows the transistor 129 to conduct in its collector-emitter output circuit and provides the emitter-base drive for the transistor 131. Transistor 131 thus rendered conductive, in place of previously conductive transistor 132, allows current to flow through the resistor 29 and into the capacitor 17. Thus, if the engine is warm, the capacitor 17 charges through both the resistor 28 and the resistor 29, but not simultaneously through both. The charging of the capacitor 17 is substantially continuous until the threshhold detector 114 senses a capacitor 17 voltage greater than that appearing at terminal 83.

If the engine is cold, the corresponding voltage at terminal 83 will be high and the capacitor voltage will necessarily have to build up to a higher level before the threshhold detector 114 of the threshhold detector 118 produces the logic one level at its output that causes the flip-flop 106 to be reset to terminate each fuel injection pulse. A pulse detector 119 has its negative input connected to the junction formed between resistors 124 and 133 of the aforementioned voltage divider. The voltage at this junction preferably is about 0.78 of the supply voltage VREF. The capacitor 17, when the engine is cold, charges not only through resistors 30 and 29 on each cycle but continues to charge through the resistor 28 because the voltage at the negative input of the threshhold detector 119 becomes greater than the reference voltage established at its positive input. When this occurs, the output of the threshhold detector 119 changes from a logic one level to a logic zero level and this causes the transistor 134 to become conductive. Simultaneously, the output circuitry of the threshhold detector 119 shunts the base-emitter circuit of the transistor 129 to render it and the transistor 131 nonconductive. Thus, the capacitor 17 continues to charge through the emitter-collector circuit of the transistor circuit 134 and resistor 30 until the voltage across the capacitor 17 exceeds the engine temperature representative voltage at the negative input of threshhold detector 114 or the reference voltage established at the negative input of the threshhold detector 118. When this occurs, the flip-flop 106 is reset as mentioned in the preceding paragraph and the fuel injection pulse is terminated as a result of the appearance of the logic zero level signals at terminals 73 and 71.

As was previously mentioned, whenever a logic one level appears at the output of the OR-gate 100, a logic one level appears at terminal 73 to provide the base drive for the Darlington transistor 34. Similarly, whenever a logic one level appears at the output of the OR-gate 102, a logic one level appears at terminal 71 to provide the base drive for the Darlington transistor 35. Circuitry connected between the output of the OR-gate 100 and terminals 73 and 72 controls the current in the inductive element of the injector 32. Identical circuitry between the OR-gate 102 and terminals 71 and 70 controls the current in the inductive element of the electromagnetic fuel injector 33.

The circuitry between the output of the OR-gate 100 and terminals 73 and 72 includes a transistor 44 having a diode 43 connected to its base and the anode of a diode 45 connected through a resistor 49 to its base. The cathode of diode 45 is connected through a resistor 47 to the terminal 72. An operational amplifier 46 has its negative input connected to the junction between the cathode of the diode 45 and the resistor 47. The output of the operational amplifier 46 is connected through a current-limiting resistor 48 to the terminal 73 that is connected to the base of the Darlington transistor 34. Corresponding circuitry is provided between the output of the OR-gate 102 and terminals 71 and 70. Diodes 53 and 55 correspond, respectively, to diodes 43 and 45, resistor 59 corresponds to resistor 49, transistor 54 corresponds to transistor 44, operational amplifier 56 corresponds to operational amplifier 46 and resistors 57 and 58 correspond to resistors 47 and 48.

In a similar manner, the circuitry between the output of the OR-gate 100 and terminals 73 and 72 further includes a resistor 91 having one of its terminals connected to ground and having another of its terminals connected through a resistor **90*a* to a voltage supply point 50*a*. The junction between the resistors 90*a* and 91 is connected to the positive input of the operational amplifier 46 to establish a reference voltage at this input. This reference voltage also is applied through a resistor 92 to the negative input of a threshhold detector 95 which has a feedback resistor 94 connected between its output and its negative input. The positive input of the threshhold detector 95 is connected through an input resistor 96 to the junction formed between the cathode of the diode 45, one of the terminals of the resistor 47 and the negative input to the operational amplifier 46. Thus, the same voltage that is supplied to the negative input of the operational amplifier 46 is applied through the input resistor 96 to the positive input of the threshhold detector 95**.

The output of the threshhold detector 95 is applied to the reset input of an RS flip-flop 99 whose Q-output is applied to the base of a transistor 98. The emitter of the is connected to ground and its collector is connected through a resistor 93 to the reference voltage supply at the junction formed between resistors **90*a* and 91. The output of the OR-gate 100 is connected through an inverter 97 to the anode of the diode 45 and through the resistor 49 to the base of the transistor 44**.

With regard to the circuitry between the output of the OR-gate 102 and terminals 71 and 70, it may be seen that the voltage that appears at the terminal **50*a* also appears at a terminal 50*b* and is supplied to a voltage divider comprising a resistor 90*b* and a resistor 61. Resistor 90*b* and resistor 61 correspond, respectively, to resistors 90*a* and 91. Similarly, resistor 62 corresponds to resistor 92, resistors 63 and 64 correspond to resistors 93 and 94, threshhold detector 65 corresponds to threshhold detector 95, resistor 66 corresponds to resistor 96, and inverter 67 corresponds to inverter 97. Flip-flop 69 corresponds to flip-flop 99 and transistor 68 corresponds to transistor 98**.

In FIG. 1 it may be seen that a capacitor 42 is connected between terminals 68 and 69 and that a resistor 41 is connected to the junction 69 and to the voltage supply at terminal 80. When the power to the fuel injection system and the microprocessor assembly first is turned on, the capacitor 42 essentially forms a short circuit between terminals 68 and 69. A transistor 142 has its base connected to the terminal 69 and has its emitter connected to ground. The collector of the transistor 142 is connected to the anodes of diodes 43 and 53, which in turn have their cathodes connected, respectively, to the bases of the transistors 44 and 54. As long as the transistor 142 is nonconductive, the anodes of the diodes 43 and 53 are supplied with a positive voltage through a resistor 141 that is connected to the junctions **50*a*, 50*b*. This forward biases the diodes 50, 43 and 53 and maintains the transistors 44 and 54 conductive. Whenever transistors 44 and 54 are conductive, the bases of the Darlington transistors 34 and 35 are coupled to ground. The Darlington transistors thus are protected and the fuel injectors 32 and 33** cannot be energized.

After the power to the system is turned on to provide voltage to terminal 80, the voltage across the capacitor 42 builds up until the transistor 142 is rendered conductive in its collector-emitter output circuit. This clamps the anodes of the diodes 43 and 53 to ground potential and the transistors 44 and 54 no longer are conductive. The logic level signals at terminals 73 and 71 then can be used to render the Darlington transistors 34 and 35 conductive as required.

The circuitry between the output of the OR-gate 100 and terminals 73 and 72 is described below to illustrate the operation of the current control portion of the injector driver circuitry illustrated in the drawings. The function of the circuitry between the output of the OR-gate 102 and terminals 71 and 70 is identical in its control of the current in the inductive element of the electromagnetic injector 33 and is not described.

If the electromagnetic injector 32 has no current flowing through its inductive element, the injector is closed. At such time, a logic zero condition exists at the output of the OR-gate 100 to produce this result. A logic one level will have been established at the reset input R of the flip-flop 99. This causes a logic level to appear at the Q-output of the flip-flop 99 and the transistor 98 is conductive. When transistor 98 is nonconductive, the resistors 90*a* and 91 form a voltage divider that establishes a relatively high reference potential at the positive input of operational amplifier 46. On the other hand, when transistor 98 is conductive, the resistors 91 and 93 are connected in parallel and this parallel combination is in series with the resistor 90*a* so that the junction connected to the positive input of the operational amplifier 46 and, through the resistor 92, to the negative input of the threshhold detector 95 is at a lower potential than appears at these locations when the transistor 98 is nonconductive. The high potential at the positive input establishes a predetermined maximum current in the inductive element of the injector 32.

The logic zero level at the output of the OR-gate 100 is inverted by the inverter 97 to cause a logic one level to occur at the anode of the diode 45 and, through the resistor 49, to the base of the transistor 44. Transistor 44 is conductive coupling the base of the Darlington transistor 44 to ground and preventing its conduction. The logic one level at the anode of the diode 45 forward biases this diode and results in the application of a logic one level signal, less the drop across diode 45, to the negative input of the operational amplifier 46 and, through the resistor 96, to the positive input of the threshhold detector 95. As a result, the voltage at the terminal 73 is at a low level. The voltage at the output of the threshhold detector 95, which is applied to the reset input R of the flip-flop 99, is at a logic one level. Thus, the transistor 98 is maintained nonconductive as long as the reset input of flip-flop 99 is at a logic one level.

When a logic one level appears at the output of the OR-gate 100 to initiate fuel injection from the injector 32, the logic one level is applied to the set input S of the flip-flop 99 causing the Q-output thereof to assume a logic zero level. This renders the transistor 98 nonconductive. Simultaneously, the inverter 97 converts the logic one level at the output of the OR-gate 100 to a logic zero level applied to the anode of the diode 45 and to the base of the transistor 44. Transistor 44 is rendered nonconductive. The input to the operational amplifier 46 and to the threshhold detector 95 then is obtained via terminal 72 connected to the current-sensing resistor 39. This resistor is in series with the collector-emitter output circuit of the Darlington transistor 34 and the inductive element of the electromagnetic fuel injector 32 and develops a small voltage proportional to the current in the inductive element.

When the transistor 98 is rendered nonconductive, the reference voltage applied to the positive input of the threshhold detector 46 is raised. Since the negative input of the operational amplifier 46 is coupled to the terminal 72, which is at ground potential at this time, the output of the operational amplifier 46 assumes a logic one level and base drive is provided to render the Darlington transistor 34 conductive. The Darlington transistor is rendered fully conductive so that substantially full battery or DC supply potential is applied via supply lead 20 and the ground circuit across the inductive element of the electromagnetic fuel injector 32. This provides, in the absence of voltage transformation, the maximum possible opening speed for the fuel injector.

Current increases in an inductive transient manner in the electromagnetic fuel injector. The current passes through the small sensing resistance 39. As the current increases, the voltage at sensing terminal 72 increases. This voltage is applied through resistors 47 and 96 to the positive input of the threshhold detector 95. The negative input of threshhold detector 95 is connected to the reference voltage appearing at the junction between the voltage divider formed by resistors 90*a* and 91. When the current in the electromagnetic injector's inductive element has built up to the point where the voltage at the positive input of the threshhold detector 95 exceeds its negative input voltage, the flip-flop 99 is reset. The transistor 98 then once again becomes conductive and resistor 93 is placed in parallel with resistor 91 to reduce the magnitude of the voltage appearing at the common junction between resistors 90*a*, 91, 92 and 93. Because the flip-flop 99 is reset when a predetermined maximum current occurs in the inductive element of the fuel injector, the high DC potential initially applied to the inductive element of the fuel injector 32 to open the injector as rapidly as possible is not permitted to produce a current in the injector's inductive element greater than the circuitry is able to withstand.

As was previously mentioned, the detection of the predetermined maximum current in the inductive element of the electromagnetic fuel injector 32 causes a reduced reference potential to be applied to the positive input of the operational amplifier 46 while at the same time the voltage at the terminal 72, proportional to the predetermined maximum current, is applied through the resistor 47 to the negative input of this threshhold detector. As a result, the output voltage of the operational amplifier 46 is substantially reduced and the base drive for the Darlington transistor 34 is correspondingly reduced. Thus, the Darlington transistor becomes less conductive and the current level in the inductive element of the fuel injector 32 decreases substantially. A holding current level is established sufficient to maintain the fuel injector open but as low as is reasonably possible to allow the closing time of the fuel injector to be minimized. Power dissipation also is minimized. The value of the various resistors in the circuitry between the OR-gate 100 and terminals 73 and 72 are selected such that the reduction in current in the inductive element of the fuel injector 32, after the predetermined maximum has been detected, brings the current to the holding level as rapidly as is reasonably possible. The voltage at terminal 72, proportional to the current in the injector, provides negative feedback to the operational amplifier 46. Again, as soon as the current level in the injector decreases, the voltage representative thereof also decreases and is applied at the negative input of the operational amplifier 46. As a result, the potential difference between this voltage and the reference voltage at the positive input increases and the Darlington transistor 34 again becomes more conductive. Thus, the holding current in the inductive element of the fuel injector is maintained at the holding level selected by the choice of circuit components.

The holding current in the inductive element of the fuel injector is maintained until a logic zero level appears at the output of the OR-gate 100. When this occurs, the inverter 97 changes the logic zero level to a logic one level that causes the transistor 44 to become conductive and clamp the base of the Darlington transistor to ground potential. The logic one level at the output of the inverter 97 is applied through the diode 45 to the negative input of the operational amplifier 46 substantially reducing its output voltage. The output diodes 36 and 38 clamp the output voltage swing at the transistors 34 and 35 to assure fast inductive field dissipation.

The supply voltage at junctions 50*a* and 50*b* is obtained at the cathode of a zener diode 140 whose anode is connected to ground. This voltage regulating device 140 itself receives a regulated voltage obtained through a resistor 139 connected to the emitter of a transistor 138. The base of the transistor 138 is connected to the cathode of another zener diode 137 whose anode is connected to ground. A resistor 136 is connected between the junction 135 and the cathode of zener diode 137. Junction 135 receives the already regulated voltage VLOS. Thus, the supply voltage at junction 50*a* is below the minimum VLOS and is closely regulated to provide precision of injector current control. As a result of the very precise regulation of the voltage for the injector's control circuitry, it is possible to allow the full DC supply potential of a motor vehicle or engine to be applied across the inductive elements of the electromagnetic fuel injectors in a fuel injection system to provide maximum response rate and minimize fuel flow rate variations in these injectors. The detection of the predetermined maximum current in the inductive elements of the injectors allows the current to be reduced to a level sufficient to hold the injectors in their open condition until the termination of the logic control signals that determine the desired fuel injection pulse width. The time required for closing the fuel injectors is minimized because only the holding current is maintained in their inductive elements subsequent to the detection of the predetermined maximum curent level.

During engine cranking and microprocessor assembly 13 default, a capacitor is selectively coupled to and forms a part of an analog computer which selectively switches transistors and impedances into circuit with the capacitor. This varies the rate at which the capacitor is charged. Fuel injection pulse width is determined by the rate at which the capacitor is charged. The charging occurs repetitively over a time interval that is limited by the temperature of the engine. The charging time interval is independent of engine speed, but is repeated at a frequency equal or proportional to engine speed.

Based upon the foregoing description of the invention, what is claimed is:

1. An analog computer circuit for controlling a fuel injection system for an internal combustion engine during engine cranking, the fuel injection system being of the type including at least one electrically controllable fuel injector which, when energized, delivers a quantity of fuel to the engine that is proportional to the duration of the energization of the fuel injector, the fuel injection system further including circuit means coupled to the fuel injector for controlling the energization of the fuel injector in response to, and for the duration of, a cyclical logic level signal, applied by the aforementioned circuit means, the analog computer circuit generating the cyclical logic level signal and comprising:

(a) means for supplying a DC voltage;
(b) a plurality of switching
(c) a capacitor;
(d) a plurality of electrical impedances coupled to the switching devices, the electrical impedances being selectively switched into conductive circuit with the capacitor by the switching devices;
(e) circuit means for controlling the switching devices as a function of the ratio of the voltage across the capacitor to the DC supply voltage;
(f) circuit means for charging the capacitor from the DC supply voltage through the plurality of electrical impedances;
(g) circuit means for discharging the capacitor at a frequency proportional to engine speed; and
(h) circuit means coupled to the electrically controllable fuel injector for generating the cyclical logic level signal, the logic level signal having a cyclically recurring duration, at one logic voltage level, that is proportional to the time over which the capacitor is charged from the DC supply voltage prior to its being discharged by the discharge circuit means.

2. An analog computer circuit according to claim 1 including a switching means coupled to the electrical impedance for switching the electrical impedances into circuit with the capacitor one at a time during each of the time intervals over which the capacitor is charged from the DC supply voltage means.

3. An analog computer circuit according to claim 1 wherein the circuit means for controlling the switching devices includes at least one threshhold detector which compares a voltage representative of the temperature of the engine with the voltage across the capacitor.

4. An analog computer circuit according to claim 2 wherein the circuit means for controlling the switching devices includes at least one threshhold detector which compares a voltage representative of the temperature of the engine with the voltage across the capacitor.

5. An analog computer circuit according to claim 3 or 4 including a temperature means for obtaining the voltage representative of the temperature of the engine from a variably resistive device responsive in its varying resistance to the temperature of the engine and connected in series with a second resistance, the variable resistance and the second resistance being coupled to the voltage of the DC supply voltage means.

6. An analog computer circuit according to claim 3 or 4 including a charging means coupled to the electrical impedance for charging the number of electrical impedances coupled to the capacitor during each of the time intervals over which it is charged as the temperature of the engine increases.

7. An analog computer circuit according to claim 1, 2, 3 or 4 including a decreasing means coupled to the electrical impedance for decreasing the number of electrical impedances coupled to the capacitor during each of the time intervals over which the capacitor is charged upon the occurrence of at least one selected engine operating temperature.

8. An analog computer circuit according to claim 7 wherein the number of electrical impedances coupled to the capacitor during each of the time intervals over which the capacitor is charged is equal to one when the engine is operating at a normal engine operating temperature.

* * * * *